US005477104A

United States Patent [19]

Tanabe et al.

[11] Patent Number: 5,477,104

[45] Date of Patent: Dec. 19, 1995

[54] SPARK PLUG RESISTANT TO ACCIDENTAL DISCHARGES

[75] Inventors: Hiroyuki Tanabe; Mamoru Musasa; Makoto Sugimoto; Masahiro Konishi, all of Nagoya, Japan

[73] Assignee: NGK Spark Plug Co., Ltd., Nagoya, Japan

[21] Appl. No.: 338,829

[22] Filed: Nov. 10, 1994

Related U.S. Application Data

[63] Continuation of Ser. No. 730, Jan. 5, 1993, abandoned.

[30] Foreign Application Priority Data

Jan. 28, 1992 [JP] Japan ..... 4-013211

[51] Int. Cl.[6] ..... H01T 13/20

[52] U.S. Cl. ..... 313/137; 313/143; 313/144

[58] Field of Search ..... 313/141, 137, 313/143, 144

[56] References Cited

U.S. PATENT DOCUMENTS

| | | | |
|---|---|---|---|
| 2,053,369 | 9/1936 | Jeffery . | |
| 2,217,825 | 10/1940 | Twining et al. | 313/141 |
| 2,356,053 | 8/1944 | Hastings, Jr. et al. | 313/137 |
| 2,458,121 | 1/1949 | Waldron | 313/137 |
| 2,483,357 | 9/1949 | Winholm | 313/137 |
| 2,576,176 | 11/1951 | Faatz | 313/137 |
| 2,863,080 | 12/1958 | Bychinsky et al. . | |
| 2,937,296 | 5/1960 | Logan | 313/141 |
| 3,344,304 | 9/1967 | Rodemacher | 313/137 |
| 3,745,400 | 7/1973 | Meyer | 313/144 |
| 4,870,319 | 9/1989 | Benedikt et al. | 313/137 |
| 4,949,006 | 8/1990 | Oshima et al. | 313/144 |
| 5,283,499 | 2/1994 | Adam et al. | 313/143 |

FOREIGN PATENT DOCUMENTS

| | | |
|---|---|---|
| 0349183 | 1/1990 | European Pat. Off. . |
| 861180 | 12/1952 | Germany . |

*Primary Examiner*—Sandra L. O'Shea
*Assistant Examiner*—Matthew J. Esserman
*Attorney, Agent, or Firm*—Sughrue, Mion, Zinn, Macpeak & Seas

[57] ABSTRACT

A spark plug includes a cylindrical metallic shell having a shoulder portion, and a tubular insulator having a stepped portion which rests on the shoulder portion within the metallic shell. The insulator has a rear half made of aluminum oxide and a front half made of aluminum nitride, the rear half having a protrusion, while the front half having a housing, and tightly joining the protrusion within the housing. An overlapping portion of the protrusion and the housing is at least partly located in a plane which is perpendicular to a longitudinal axis of the center electrode, the plane passing through the shoulder portion of the metallic shell.

4 Claims, 4 Drawing Sheets

1
2
3
5
6
a
b
d

SPARK PLUG RESISTANT TO ACCIDENTAL DISCHARGES

This is a continuation of application Ser. No. 08/000,730 filed Jan. 5, 1993, now abandoned.

BACKGROUND OF THE INVENTION

FIELD OF THE INVENTION

This invention relates to a spark plug in which an insulator is supported by resting its stepped portion on a shoulder portion of a metallic shell.

In a spark plug for an internal combustion engine, an insulator has generally been made of aluminum oxide ($Al_2O_3$) which is inferior in heat-conductivity.

With high speed and high power requirement of the internal combustion engine, a front end of the insulator tends to be exposed to higher ambient temperature so as to cause preignition. In order to prevent the spark plug against the preignition, it is suggested in an integral type of the spark plug that the insulator is integrally made of aluminum nitride (AlN) superior in heat-conductivity so as to prevent preignition within an extensive range of running condition of the internal combustion engine.

In Provisional Patent Application No. 2-183985 filed on Jan. 6, 1989 which was laid open on Jul. 18, 1990 and was published on Jun. 8, 1994 as JP 6-44504, the applicant of the invention had suggested a split-type insulator which has a rear half made of aluminum oxide and a front half made of aluminum nitride, and the rear half is joined to the front half.

In the integral type of the spark plug, a shortage of withstand voltage of the insulator causes a spark discharge to penetrate across the insulator so as to ensue a misfire when a high tension is applied across the spark plug. This is because the aluminum nitride (AlN) is inferior to the aluminum oxide ($Al_2O_3$) in withstanding high voltage. It is very often that the spark discharge penetrates across the portion in which the insulator is next to or opposite the shoulder portion of the metallic shell, since the stepped portion of the insulator rests on the shoulder portion.

In the split-type insulator, the spark discharge frequently penetrates across the front half of the insulator from the reason that the shoulder portion of the metallic shell directly comes across an entire section of the front half made of aluminum nitride.

SUMMARY OF THE INVENTION

It is an object of the invention to provide a spark plug which is capable of effectively preventing a spark discharge from penetrating across an insulator with a relatively simple structure.

According to the invention, a tubular insulator has a rear half made of aluminum oxide and a front half made of aluminum nitride. The rear half has a protrusion which is joined to a housing provided with the front half. An overlapping portion of the protrusion and the housing is at least partly located in coplanar relationship with the shoulder portion.

Such is the structure that a spark discharge is effectively prevented from penetrating across the insulator by increasing a diameter of the protrusion of the rear half which is superior in withstanding a high voltage.

Further, the protrusion of the rear half is air-tightly joined to the housing by means of glass sealant or heat-resistent adhesive so that it is possible to avoid a voltage leakage through a joining surface between the protrusion and the housing.

These end other objects and advantages of the invention will be apparent upon reference to the following specification, attendant claims and drawings.

DETAILED DESCRIPTION OF THE EMBODIMENTS

Figure 1:
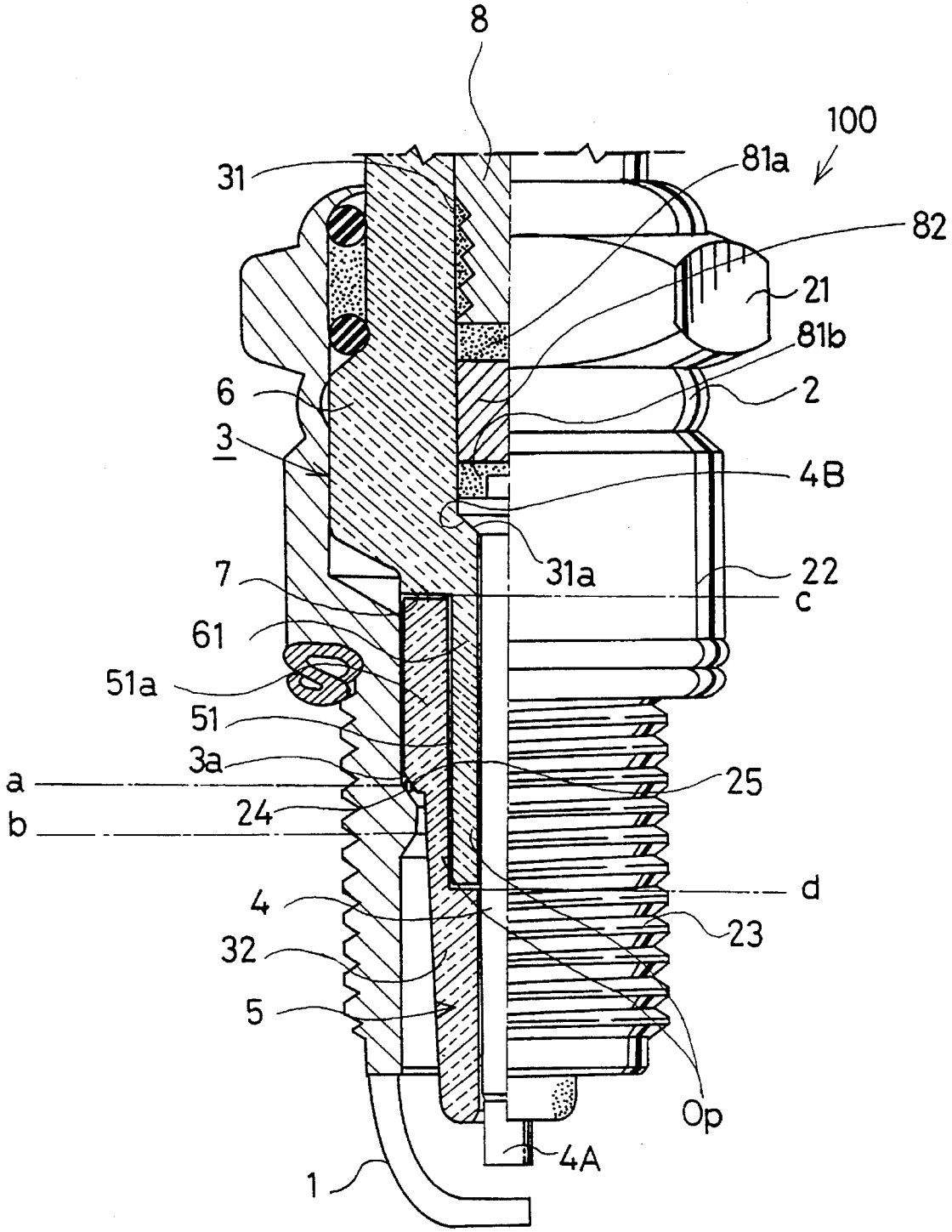
FIG. 1 is a longitudinal half-sectional view of a spark plug according to an embodiment of the present invention, but its upper part is broken away.
Figure 2:
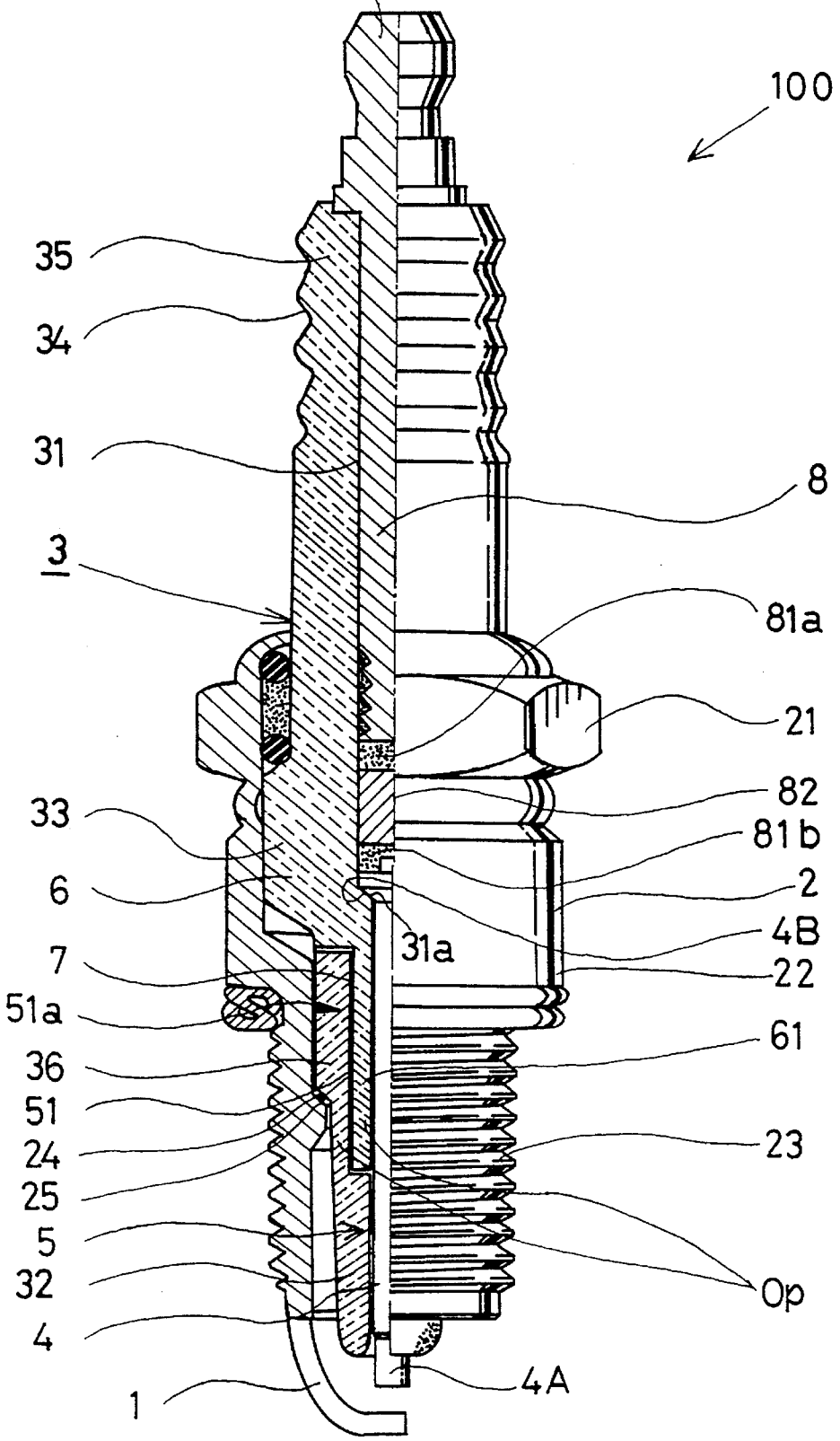
FIG. 2 is a full longitudinal half sectional view of a spark plug according to the same embodiment of the invention as FIG. 1.

Referring to FIGS. 1 and 2 which substantially show a spark plug 100, the spark plug 100 has a cylindrical metallic shell 2, to a front end of which a L-shaped ground electrode 1 is fixedly attached by means of welding. Within the metallic shell 2, is a tubular insulator 3 placed, an inner space of which serves as an axial bore 31. Within the bore 31, a center electrode 4 is concentrically placed.

An outer surface of the metallic shell 2 has a diameter-increased hexagonal head 21, a barrel portion 22 and a threaded portion 23 which is to be attached to a cylinder block of an internal combustion engine. Each inner diameter of the hexagonal head 21 and the barrel portion 22 is enlarged, while an inner diameter of the threaded portion 23 is smaller. An inner wall of the threaded portion 23 has a shoulder portion 24 on which a stepped portion 3*a* rests by way of a gasket 25. The stepped portion 3*a* is provided with the insulator 3 to support the insulator 3 within the metallic shell 2. The shoulder portion 24 includes an upper shoulder and lower shoulder as indicated at (a), (b) in FIG. 1.

As illustrated in FIG. 2, the insulator 3 has a tapered leg portion 32, a diameter-increased portion 33 and a head 35 whose outer surface has a corrugation 34. Between the diameter-increased portion 33 and the leg portion 32, is a middle portion 36 provided which is diametrically somewhat larger than the leg portion 32. The insulator 3 has a rear half 6 made of aluminum oxide ($Al_2O_3$) and a front half 5 made of aluminum nitride (AlN) so as to form a split-type insulator. The front half 5 includes the middle portion 36. With a rear end surface of the middle portion 36, is a cylindrical recess 51 provided which extends to the leg portion 32 to form a housing 51*a* in a manner to surround the recess 51.

The rear half 6 includes the diameter-increased portion 33 whose front end integrally has a protrusion 61. The protrusion 61 is air-tightly joined to the housing 51*a* by means of a heat-resistant adhesive (a silicon resin) 7 or a glass sealant.

In this instance, an overlapping portion (Op) of the protrusion 61 and the housing 51*a* is at least partly parallel to upper and lower shoulders (a), (b) illustrated in FIGS. 1, 2.

Meanwhile, the center electrode 4 is inserted to the axial bore 31 whose inner wall has a ledge portion 31*a*. The center electrode has a flange head 4B which rests on the ledge portion 31*a* to bring the protrusion 61 into a tight engagement with an inner wall of the housing 51*a*. To a rear end of the center electrode 4, is a terminal 83 and a middle axis 8 connected by way of a monolithic resistor 82 interposed between conductive glass seals 81*a*, 8l*b*.

Meanwhile, a front end of the spark plug 100 is, in use, projected into a combustion chamber on the internal combustion engine. When high voltage is applied across the electrodes, a spark discharge can occur across the portion in which the upper and lower shoulders (a), (b) directly meet the insulator if the insulator is poor in withstanding the high voltage. In order to avoid the occurrence of the spark discharge, the $Al_2O_3$-made protrusion 61 which is superior in withstanding the high voltage is extended past upper and lower shoulders (a), (b) Around the protrusion 61, is the housing 51*a* located which is superior in heat-conductivity. With this structure, the heat of the front end 4A of the spark plug 100 is favorably dissipated to the metallic shell 2 by way of the front half 5, the gasket 25, the stepped portion 3*a* and the shoulder portion 24. The insulator is capable of withstanding the high voltage by reducing thickness of the housing 51*a* and by increasing the diameter of the protrusion 61 which is superior in withstanding the high voltage.

The adhesive 7 used at the joining surface between the protrusion 61 and the housing 51*a* is a glass sealant or a synthetic resin to sufficiently resist against the high voltage. The glass sealant is very fine, and having a good wetting relationship with the protrusion 61 and the housing 51*a*. A coefficient of the thermal expansion of the glass sealant is preferably $5\sim8\times10^{-6}/°C$. which is intermediate between that of aluminum nitride (AlN) and that of aluminum oxide ($Al_2O_3$).

Upon using the glass sealant which has a high softening point, the protrusion 61 is joined to the housing 51*a* by means of the glass sealant prior to thermally encapsulating the conductive glass seals 81*a*, 81*b*, the monolithic resistor 82 and the terminal 83 into the insulator 3 (prior joint system). On carrying out the prior joint, it is necessary to use a heat-resistant glass sealant so as not to be melted when thermally encapsulating or hot pressing the conductive glass seals 81*a*, 81*b*, the monolithic resistor 82 and the terminal 83.

Upon using the glass sealant which has a intermediate softening point, the protrusion 61 is joined to the housing 51*a* by means of the glass sealant, and simultaneously thermally encapsulating the conductive glass seals 81*a*. 81*b*, the monolithic resistor 82 and the terminal 83 into the insulator 3 (simultaneous joint system). On carrying out the simultaneous joint system, it is necessary to use the heat-resistant glass sealant having a softening point similar to the glass seals.

Upon using the glass sealant which has a low softening point, the protrusion 61 is joined to the housing 51*a* by means of the glass sealant after thermally encapsulating the conductive glass seals 81*a*, 81*b*, the monolithic resistor 82 and the terminal 83 into the insulator 3 (post joint system). The post joint system enables to use inexpensive resin when the joint portion is used in a sufficiently low temperature ambience. It is a matter of course that the adhesive needs high voltage resistant and high insulation property.

A spark-endurance experiment is carried out at full load and 5000 rpm for 100 hours with the spark plug mounted on a four-cylinder, 2000 cc engine by changing the joint system. Results of the experiment are shown in the Table. FIGS. 4*a*~4*f* show counterpart spark plugs as examples how a spark discharge occurs across the insulator.

TABLE

Figure 3:
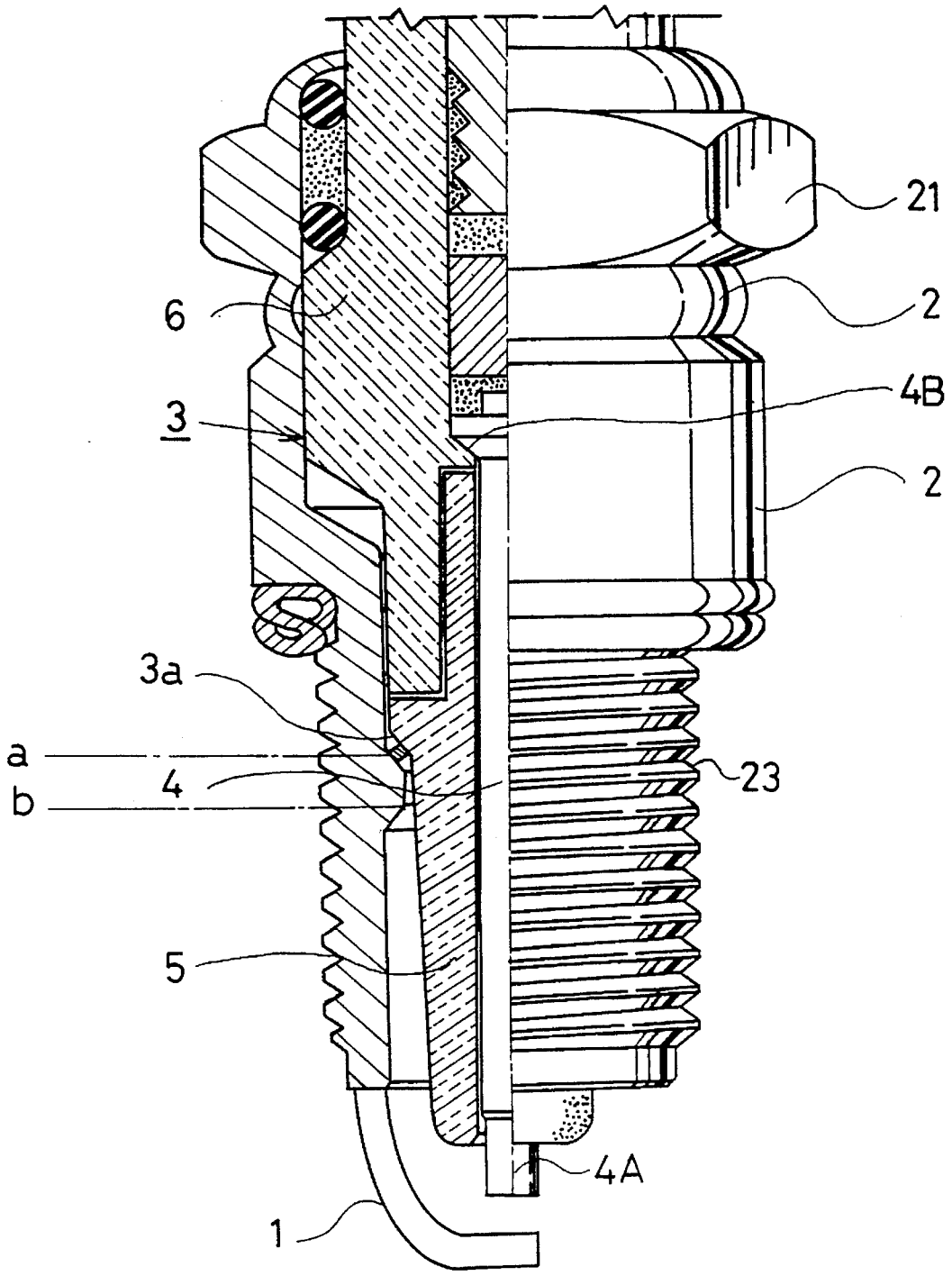
FIG. 3 is a longitudinal half-sectional view of a previous in-house spark plug and employed for the purpose of carrying out endurance test.

| | split type or integral type | joint system | adhesive | dimension (mm) (c)–(d) | (b)–(d) | result |
|---|---|---|---|---|---|---|
| A | split type AlN + $Al_2O_3$ | prior joint system | glass sealant of high softening point (950° C.) | 15 | 8 | favorable |
| B | split type AlN + $Al_2O_3$ | simultaneous joint system | glass sealant of intermediate softening point (700° C.) | 12 | 7 | favorable |
| C | split type AlN + $Al_2O_3$ | post joint system | glass sealant of low softening point (350° C.) | 12 | 4 | favorable |
| D | split type AlN + $Al_2O_3$ | post joint system | heat-resistant resin (300° C.) | 8 | 3 | favorable |
| E | split type AlN + $Al_2O_3$ | simultaneous joint system | glass sealant of intermediate softening point (700° C.) | 10 | 3 | favorable |
| F | split type AlN + $Al_2O_3$ | post joint system | heat-resistant resin (harden at normal temperature) | 12 | 3 | favorable |
| G | integral type AlN | — | — | — | — | spark occurs at (a), (b) |
| H | split type AlN + AlN | prior joint system | glass sealant of high softening point (950° C.) | 15 | 8 | spark occurs at (a), (b) |
| I | split type AlN + $Al_2O_3$ | simultaneous joint system | glass sealant of intermediate softening point (700° C.) | 7 | 0 | spark occurs at (b) |
| J | split type AlN + $Al_2O_3$ | post joint system | heat-resistant resin (harden at 300° C.) | 3 | *–4 | spark occurs at (b) |
| K | split type AlN + $Al_2O_3$ | prior joint system | glass sealant of high softening point (950° C.) | shown in FIG. 3 | | spark occurs at (a), (b) |
| L | split type AlN + $Al_2O_3$ | | no adhesive used | 15 | 8 | spark leaks through joint portion between the protrusion and the recess |

*Asterisk shows that (d) positions rearwards (b).

According to specimens (A) and (B) of the invention, the protrusion 61 is fitted into the recess 51 deeply as shown by a distance between (c) and (d) in FIG. 1. In this instance, the overlapping portion of the protrusion 61 and the housing 51*a* is exposed to a high temperature ambiance, a glass sealant having a high or intermediate softening point is used as an adhesive.

In the case of specimens (C), (D) and (F) of the invention, the protrusion 61 is fitted into the recess 51 not so deeply, the overlapping portion of the protrusion 61 and the housing 51*a* is not exposed to a high temperature ambiance, a glass sealant having a synthetic resin or a low softening point is used as an adhesive.

In the case of specimen (E) the invention, the protrusion 61 is fitted into the recess 51 not so deeply, and the simultaneous system is adopted. It is found in any specimens (A) (E) that no spark discharge penetrates across the insulator during 100 hours of experimentation.

Figures 4A, 4B, 4C, 4D, 4E, 4F:
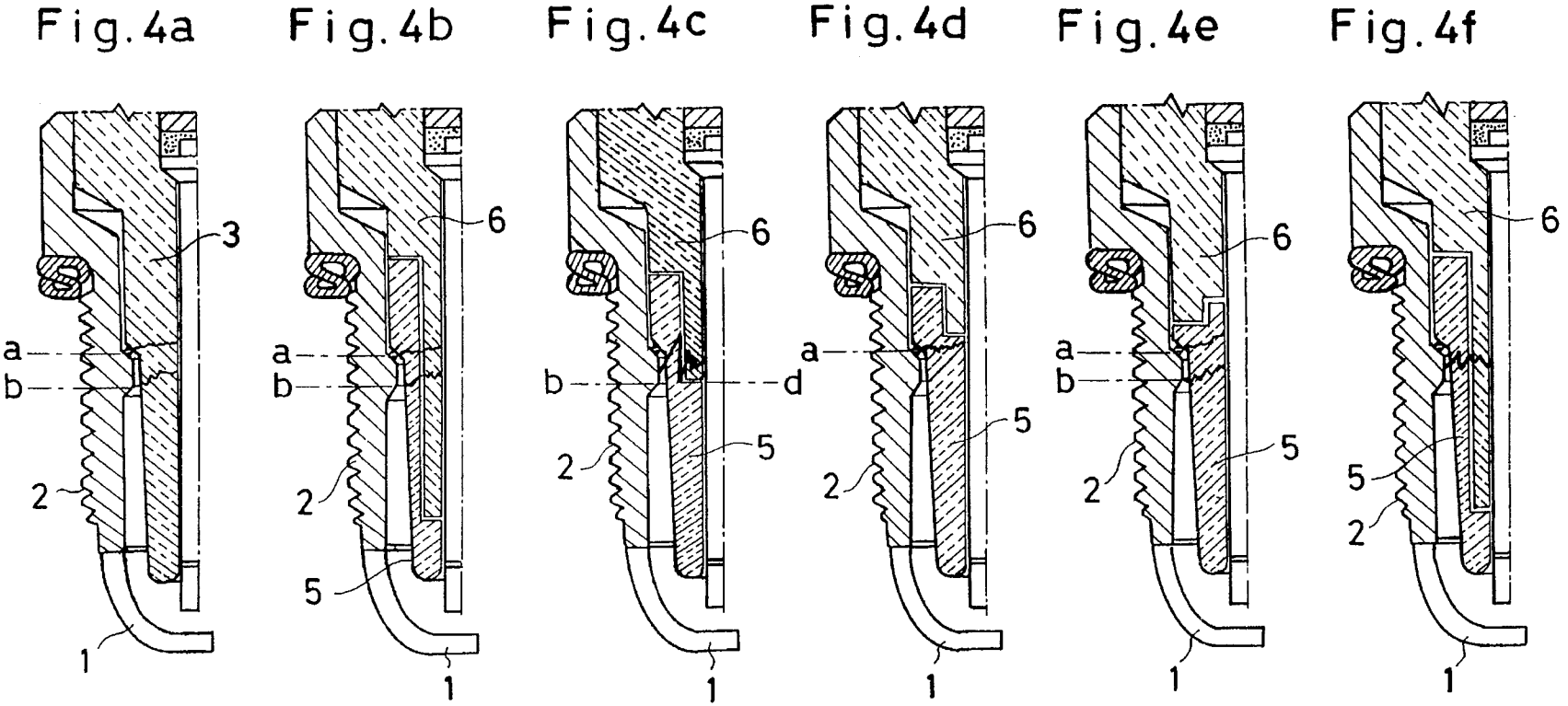
FIGS. 4*a*~4*f* are longitudinal cross sectional views of previous in-house spark plugs to show examples in which a spark discharge occurs across an insulator.

In the case of counterpart specimen (G) in which the insulator is integrally made of aluminum nitride as shown in FIG. 4*a*, it is found that a spark discharge penetrates across the insulator in a few hours since the experiment has begun.

In the case of counterpart specimen (H) in which the rear half and front half of the insulator are made of aluminum nitride respectively as shown in FIG. 4*b*, it is found that a spark discharge penetrates across the insulator in a few hours because the adhesive can't withstand the high voltage.

In the case of counterpart specimen (I) in which a front end of the protrusion 61 is in flush with the lower shoulder (b) as shown in FIG. 4*c*, it is found that a spark discharge penetrates across the insulator earlier than the specimen (G).

In the case of counterpart specimen (J) in which the overlapping portion of the protrusion 61 and the housing 51*a* is out of the plane in which the shoulder portion 3*a* forms around the inner wall of the metallic shell 2 as shown in FIG. 4*d*, it is found that a spark discharge penetrates across the insulator in a few hours.

In the case of counterpart specimen (K) in which the rear half 6 has the recess 51, and the front half 5 has the protrusion 61 as shown in FIG. 4*e*, the shoulder portion 3*a* directly meets the front half 5 so that a spark discharge penetrates across the insulator in a few hours.

In the case of counterpart specimen (L) in which the insulator 3 is similar to the specimen (A), but no adhesive is used between the protrusion 61 and the housing 51*a* as shown in FIG. 4*f*, it is found that a spark discharge penetrates cross the insulator for the shortage of tightness between the protrusion 61 and the housing 51*a*.

In any case of the counterpart specimens (G)~ (K), it is found that a spark discharge penetrates across the insulator to cause a misfire for the shortage of an insulating resistance and withstand voltage.

As understood from the foregoing description, the front half 5 made of aluminum nitride which is inexpensive and superior in heat-conductivity in order to quickly transmit the heat of the front end of the spark plug, while the rear half is made of aluminum oxide which is superior in withstanding the high voltage.

Further, the heat-resistant adhesive 7 which is superior in insulation, is used as an adhesive between the protrusion 61 and the housing 51*a*. This enables to provide an economic and reliable spark plug which is capable of preventing a spark discharge from penetrating across the insulator.

It is appreciated that a male thread may be made on an outer surface of the protrusion 61, while a female thread made on an inner wall of the housing 51*a*, and the protrusion 61 may be screwed into the housing 51*a* so as to integrate the protrusion 61 into the housing 51*a*.

While, the invention has been described with reference to the specific embodiments, it is understood that this description is not to be construed in a limiting sense inasmuch as various modifications and additions to the specific embodiments may be made by skilled artisans without departing from the spirit and scope of the invention.

It is noted that a glass sealant may be used instead of the heat-resistant adhesive.

What is claimed is:

1. In a spark plug including a cylindrical metallic shell having a shoulder portion, and a tubular insulator having a stepped portion which rests on the shoulder portion within the metallic shell, and a center electrode placed within the insulator, the spark plug comprising:

the insulator having a rear half made of aluminum oxide and a front half made of aluminum nitride, the rear half having a protrusion, while the front half having a housing, and tightly joining the protrusion within the housing;

an overlapping portion of the protrusion and the housing being at least partly located in a plane which is perpendicular to a longitudinal axis of the center electrode, said plane passing through the shoulder portion of the metallic shell.

2. In a spark plug as recited in claim 1, wherein the protrusion of the rear half is bonded to the housing of the front half by means of a glass sealant or a heat-resistant adhesive.

3. In a spark plug as recited in claim 2, wherein the glass sealant has a coefficient of thermal expansion intermediate between that of the rear half and that of the front half of the insulator.

4. In a spark plug as recited in claim 3, wherein the coefficient of the thermal expansion of the glass sealant is in a range of $5\sim8\times10^{-6}/°C$.

* * * * *